US006269785B1

(12) United States Patent
Adachi

(10) Patent No.: US 6,269,785 B1
(45) Date of Patent: Aug. 7, 2001

(54) VARIABLE VALVE TIMING MECHANISM

(75) Inventor: Michio Adachi, Obu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/546,713

(22) Filed: Apr. 10, 2000

Related U.S. Application Data

(63) Continuation-in-part of application No. 09/238,180, filed on Jan. 28, 1999, now abandoned.

(30) Foreign Application Priority Data

Jan. 29, 1998 (JP) ..... 10-16806

(51) Int. Cl.[7] ..... F01L 1/34

(52) U.S. Cl. ..... 123/90.17; 123/90.15; 123/90.31; 123/90.12

(58) Field of Search ..... 123/90.17, 90.31, 123/90.12, 90.15, 90.37, 90.38; 74/568 R; 464/1, 2, 160, 161

(56) References Cited

U.S. PATENT DOCUMENTS 5,209,194 * 5/1993 Adachi et al. ..... 123/90.17
5,474,038 12/1995 Golovatai-Schmidt et al. .
5,483,930 * 1/1996 Moriya et al. ..... 123/90.17
5,522,352 * 6/1996 Adachi et al. ..... 123/90.15
5,666,914 9/1997 Ushida et al. .
5,669,343 * 9/1997 Adachi ..... 123/90.17
5,724,928 * 3/1998 Morii et al. ..... 123/90.17
5,727,508 3/1998 Goppelt .
5,794,577 8/1998 Kira .
5,832,887 * 11/1998 Adachi et al. ..... 123/90.17
5,836,276 * 11/1998 Iwasaki et al. ..... 123/90.17
5,836,279 11/1998 Strauss .
5,860,397 1/1999 Schafer .
5,865,150 2/1999 Kramer et al. .
5,865,151 * 2/1999 Fukaya et al. ..... 123/90.17
5,875,750 3/1999 Iwasaki et al. .
5,931,126 8/1999 Eguchi et al. .
5,937,810 8/1999 Sato et al. .
6,024,061 * 2/2000 Adachi et al. ..... 123/90.17
6,045,338 * 4/2000 Morita ..... 123/90.17
6,129,060 * 10/2000 Koda ..... 123/90.17
6,129,062 * 10/2000 Koda ..... 123/90.17
6,186,104 * 2/2001 Torii et al. ..... 123/90.17

FOREIGN PATENT DOCUMENTS 9-151710 6/1997 (JP) .

* cited by examiner

*Primary Examiner*—Teresa Walberg
*Assistant Examiner*—Fadi H. Dahbour
(74) *Attorney, Agent, or Firm*—Nixon & Vanderhye P.C.

(57) ABSTRACT

A cylindrical bush is provided at the distal end of an oil distributor inserted from the front cover side of a housing to prevent pressure oil from leaking from hydraulic chambers via a clearance formed between the hydraulic chambers and the housing. Further, sealing members are provided on both sides in the axial direction of a connecting section between an oil passage for supplying pressure oil to advancing hydraulic chambers and the oil distributor. The sealing members prevent a leakage from the connecting section.

20 Claims, 4 Drawing Sheets

VARIABLE VALVE TIMING MECHANISM

CROSS REFERENCE TO RELATED APPLICATION

This application is a CIP application of U.S. application Ser. No. 09/238,180, filed on Jan. 28, 1999 now abn and is based upon and claims priority from Japanese Patent Application No. Hei 10-16806 filed Jan. 29, 1998, the contents of which are incorporated herein by reference.

BACKGROUND OF THE INVENTION

1. Field of the Invention

The present invention relates to a variable valve timing mechanism for changing opening/closing timing of at least an inlet valve or an exhaust valve of an internal combustion engine (hereinafter referred to simply as an "engine") according to engine operating conditions.

2. Description of Related Art

Hitherto, there has been known a vane type variable valve timing mechanism as disclosed in JP-A-8-121123 as a variable valve timing mechanism for driving a camshaft via a timing pulley and a chain sprocket which rotate in synchronism with a crank shaft of an engine to give a phase difference by relative rotation between the timing pulley and the chain sprocket and the camshaft.

The vane type variable valve timing mechanism relatively rotates the crank shaft and the camshaft by rotating vanes by a pressure difference between two hydraulic chambers provided on both sides in each vane in the circumferential direction.

The conventional variable valve timing mechanism supplies oil to respective hydraulic chambers via oil passages provided within the camshaft. However, it may be preferable to supply hydraulic pressure from an end opposite to the camshaft (front side) because of the design condition for the engine when, for example, it is difficult to provide the oil passage within the camshaft.

Another known helical type variable valve timing mechanism is disclosed in JP-A-7-507120 (PCT publication number in Japan). This helical type variable valve timing mechanism supplies hydraulic pressure from the end of the front side. However, the helical type variable valve timing mechanism has such problems that it requires a large number of parts.

Furthermore, in case of the vane type variable valve timing mechanism, a clearance between a vane rotor and a housing member is required because the vane rotor rotates relative to the housing member. It then becomes difficult to control the phase difference between the vane rotor and the housing member with high degree of accuracy when pressure oil within the hydraulic chamber leaks via this clearance. Therefore, it is important to reduce the leak of the oil for the vane type variable valve timing mechanism.

SUMMARY OF THE INVENTION

The present invention is made in light of the foregoing problems, and it is an object of the present invention to provide a variable valve timing mechanism which can reduce the leakage of the pressure oil from the hydraulic chambers and the oil passages in the variable valve timing mechanism supplying pressure oil from the front side.

According to a variable valve timing mechanism of the present invention, it includes a housing, a vane rotor having a plurality of oil pressure chambers in a circumferential direction of the vane rotor for rotating relative to the housing by controlling an oil pressure in the oil pressure chambers and being accommodated in the housing, and an oil distributor for distributing an oil to the oil pressure chambers from an end of the housing opposite to the other end of the housing supporting a driven shaft.

The oil supply to the oil pressure chambers is carried out via an oil passage installed in the oil distributor, and an oil passage in the driven shaft is obviated. Accordingly, the oil is supplied from the front side, that is, from the end of the housing opposite to the other end of the housing supporting the driven shaft.

According to another aspect of the present invention, an oil passage is formed in the housing. Accordingly, the oil supply to the oil pressure chambers is supplied from a location separated from a small clearance between the housing and the vane rotor. Therefore, an oil leakage via the clearance is reduced.

According to another aspect of the present invention, the variable valve timing mechanism of the present invention includes a cylindrical member disposed between the oil distributor and at least one of the housing and the vane rotor for preventing the oil from leaking from the oil pressure chambers via the clearance between the housing and the vane rotor. Therefore, an oil leakage from the oil pressure chambers is reduced.

BRIEF DESCRIPTION OF THE DRAWINGS

Other features and advantages of the present invention will be appreciated, as well as methods of operation and the function of the related parts, from a study of the following detailed description, the appended claims and the drawings, all of which form a part of this application. In the drawings:

DESCRIPTION OF PREFERRED EMBODIMENT (First Embodiment)

A first embodiment of a variable valve timing mechanism to which the present invention is applied will now be explained based on FIGS. 1 and 2.

Figure 1:
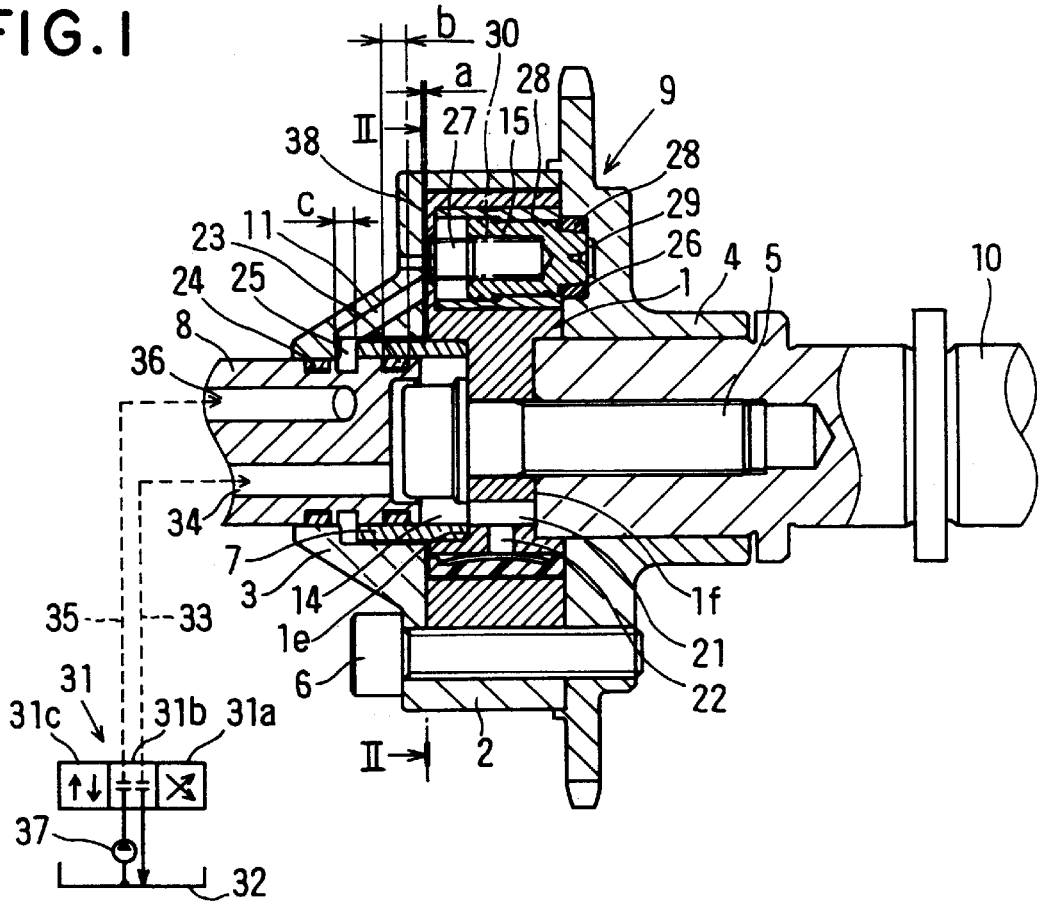
FIG. 1 is a longitudinal cross section of a variable valve timing mechanism according to a first embodiment of the present invention.
Figure 2:
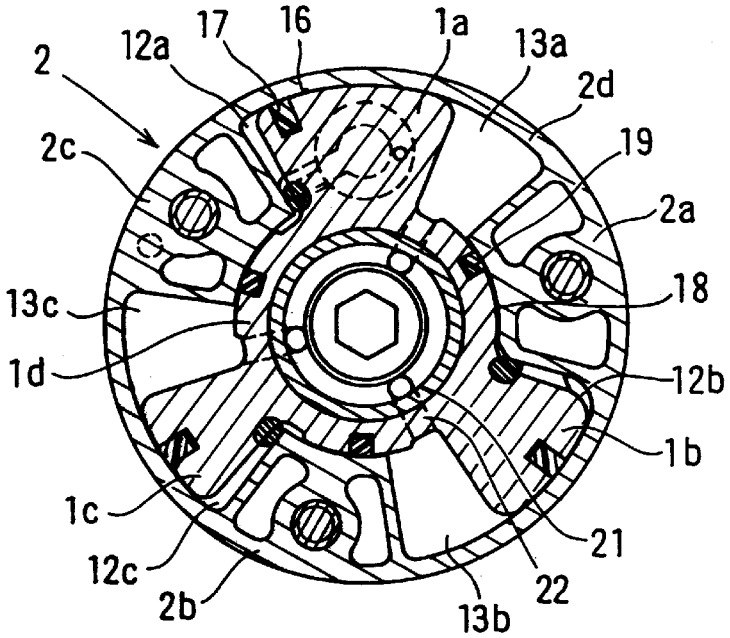
FIG. 2 is a transverse cross section of the variable valve timing mechanism taken along a line II—II in FIG. 1 according to the first embodiment of the present invention.

FIG. 1 is a longitudinal cross section of the variable valve timing mechanism, taken along the line through the main part thereof shown in FIG. 2. The variable valve timing mechanism is provided at the end portion of a camshaft 10, and rotates together with the camshaft 10. The camshaft 10 extends from one end of the variable valve timing mechanism, and a static oil distributor 8 is disposed on the other end of the variable valve timing mechanism.

Driving force is transmitted to a rear plate 4 as a housing from a crank shaft of the engine as a driving shaft (not shown) via a gear provided at an outer periphery of the rear plate 4, and the rear plate 4 rotates in synchronism with the crank shaft. The camshaft 10 as a driven shaft opens/closes at least one of an inlet valve and an exhaust valve not shown. The camshaft 10 is capable of rotating relative to the rear plate 4 within certain range of a predetermined phase difference.

FIG. 2 is a transverse cross section showing the variable valve timing mechanism taken along a line A—A in FIG. 1. The rear plate 4 and the camshaft 10 rotate clockwise in FIG. 2. This clockwise direction is defined as an advancing direction hereinafter.

As shown in FIG. 2, a shoe housing 2 has trapezoidal shoes 2*a*, 2*b* and 2*c* disposed almost at equal angular intervals in the circumferential direction. The shoes 2*a*, 2*b* and 2*c* are connected by a cylindrical peripheral wall 2*d*. Each edge of the inner peripheral side of the shoes 2*a*, 2*b* and 2*c* is formed in an arc shape. Sectorial spaces as chambers for accommodating vanes 1*a*, 1*b* and 1*c* are formeded in the peripheral direction between the shoes 2*a*, 2*b* and 2*c*.

A vane rotor 1 includes a cylindrical supporting member 1*d* and the vanes 1*a*, 1*b* and 1*c*. The vanes 1*a*, 1*b* and 1*c* are provided almost at equal angular intervals on the outer periphery of the supporting member 1*d*, extending radially to the outside. The vanes 1*a*, 1*b* and 1*c* are formed with the supporting member 1*d* and rotate together with the supporting member 1*d*. The vanes 1*a*, 1*b* and 1*c* are formed in the sectorial shape, and are rotatably accommodated in the sectorial spaces created between the shoes 2*a*, 2*b* and 2*c*. The vane rotor 1 and the camshaft 10 are positioned in the rotating angle direction by a knock pin not shown. Accordingly, the camshaft 10 and the vane rotor 1 can rotate coaxially and relative to a housing main body 9 comprising the rear plate 4, the shoe housing 2 and a front cover 3.

As shown in FIG. 2, a retarding hydraulic chamber 13*a* is formed between the vane 1*a* and the shoe 2*a*, and a retarding hydraulic chamber 13*b* is formed between the vane 1*b* and the shoe 2*b*, and a retarding hydraulic chamber 13c is formed between the vane 1*c* and the shoe 2*c*. Further, an advancing hydraulic chamber 12*a* is formed between the vane 1*a* and the shoe 2*c*, and an advancing hydraulic chamber 12*b* is formed between the vane 1*b* and the shoe 2*a*, and an advancing hydraulic chamber 12*c* is formed between the vane 1*c* and the shoe 2*b*.

A small clearance 16 is created between the outer peripheral surfaces of the vanes 1*a*, 1*b* and 1*c* and the inner peripheral surface of the cylindrical peripheral wall 2*d* as shown in FIG. 2, and is hermetically sealed by sealing members 17 attached to the respective vanes 1*a*, 1*b* and 1*c*. A small clearance 18 created between the trapezoidal end of the shoes 2*a*, 2*b* and 2*c* and the supporting member 1*d* is hermetically sealed by sealing members 19 provided on the outer peripheral wall of the supporting member 1*d*. Accordingly, the neighboring hydraulic chambers among the advancing hydraulic chambers 12*a*, 12*b* and 12*c* and the retarding hydraulic chambers 13*a*, 13*b* and 13*c* are prevented from communicating each other via the clearances 16 and 18.

Because the front cover 3 and the vane rotor 1 rotate relative to each other, a small clearance 38 having a gap "a" is provided therebetween. The length of the vanes 1*a*, 1*b* and 1*c* in the circumferential direction is substantially long. Therefore, the communication between the advancing hydraulic chambers and the retarding hydraulic chambers may be suppressed by sealing the small clearance 38 between the vanes 1*a*, 1*b* and 1*c* and the front cover 3.

As shown in FIG. 1, a stopper piston 15 is accommodated in the vane 1*a*, and fits in a tapered stopper hole 26 formed in the rear plate 4. A spring 30 is assembled in an accommodation hole 27 on the left side of the axial direction of the stopper piston 15 in FIG. 1. A guide ring 28 is loosely fitted or press-fitted in the inner wall of the vane 1*a* forming the accommodation hole 27 and is loosely fitted with the outer wall of the stopper piston 15. Accordingly, the stopper piston 15 is accommodated in the vane 1*a* in such a manner that the stopper piston 15 can slide in the axial direction of the camshaft 10. The stopper piston 15 is biased toward the rear plate 4 by the spring 30. The stopper piston 15 fits into the stopper hole 26 or is pulled out from the stopper hole 26 according to the balance between force received from hydraulic chambers 28 and 29 and the bias force (spring force) of the spring 30. When the stopper piston 15 is pulled out from the stopper hole 26, the vane rotor 1 is disengaged from the rear plate 4, and becomes free to rotate relative to the shoe housing 2 within the angle range from the most retarded position to the most advanced position.

The rear plate 4, the shoe housing 2 and the front cover 3, as the housing member, are fastened and fixed coaxially by a bolt 6, thereby forming the housing main body 9. A truncated conical protrusion is formed on the front cover 3 from the center part thereof toward the outside of the housing, and a circular opening is formed at the center thereof. A cylindrical bush 7 described later is loosely fitted in the opening from the side forming the interior of the housing main body 9, and the oil distributor 8 described later is inserted from the side forming the exterior of the housing main body 9. The diameter of the part of the opening of the front cover 3 where the cylindrical bush 7 is loosely fitted is increased by the thickness of the cylindrical bush 7. The inner diameter of the cylindrical bush 7 is set so as to be able to insert the oil distributor 8. As a result, a circular insertion hole whose diameter is constant is created at the center of the front cover 3 by the small diameter section of the opening formed through the front cover 3 and by the cylindrical bush 7 loosely fitted in the large diameter section of the opening.

Hollow portions 1*e* and 1*f* are formed at the center of the vane rotor 1 on the both sides thereof. The camshaft 10 is engaged with the hollow portion 1*f* of the vane rotor 1 on the rear plate 4 side at its end, and is fastened and fixed coaxially by a center bolt 5. The cylindrical bush 7 which is longer than the depth of the hollow portion 1*e* in the axial direction is press-fitted and fixed up to the bottom of the hollow portion 1*e* of the vane rotor 1 on the front cover 3 side. The other end of the cylindrical bush 7 is loosely fitted in the opening at the center of the front cover 3. The hole for inserting the oil distributor 8 described above may be formed by inserting the cylindrical bush 7 into the opening at the center of the front cover 3. It is noted that the end of the cylindrical bush 7 on the opposite side from the vane rotor 1 forms a connecting section 25 described later for connecting an oil passage 11 and an oil passage within the oil distributor 8.

The oil distributor 8 is connected from the left side of the opening formed through the front cover 3 as shown in FIG. 1. An oil passage 34 for supplying oil to the retarding hydraulic chambers 13*a*, 13*b* and 13*c* and an oil passage 36 for supplying oil to the advancing hydraulic chambers 12*a*, 12*b* and 12*c* are formed within the oil distributor 8.

The oil distributor 8 is inserted up to the position where the distal end thereof does not contact with the head of the center bolt 5 penetrating through the center shaft of the vane rotor 1. The outer peripheral portion of the distal end of the oil distributor 8 is loosely fitted in the inner peripheral surface of the cylindrical bush 7.

Accordingly, a space 14 into which oil flows from the oil passage 34 is formed around the head of the center bolt 5.

An oil passage 2l is perforated axially from the hollow portion 1*e* of the vane rotor 1. Further, an oil passage 22 for supplying oil from the oil passage 21 to the retarding hydraulic chamber 13*b* via the inside of the supporting member 1*d* is perforated in the radial direction. As a result, the oil passage for supplying pressure oil from the space 14 to the retarding hydraulic chamber 13*b* via the oil passages 21 and 22 is formed. The oil passages 21 and 22 are provided also for the other retarding hydraulic chambers 13*a* and 13*c*, and those oil passages are formed radially from the space 14 to respective retarding hydraulic chambers.

The oil passage 11 for supplying oil to the advancing hydraulic chamber 12*a* via the inside of the front cover 3 is perforated through the front cover 3. The oil passage 11 is connected to the oil passage 36 via the connecting section 25. The oil passage 11 is provided also for the other advancing hydraulic chambers 12*b* and 12*c* similarly from the oil passage 36 radially through the inside of the front cover 3.

The oil passage 11 is perforated so as to go along with the slope of the truncated conical protrusion from the surface of the front cover 3 contacting with the vane rotor 1. Burr may be produced at the region of the opening at the center of the front cover 3 in perforating the oil passage 11 as described above. However, this burr may be removed readily because it is produced in the direction toward the center opening from the oil passage 11.

Ring-shaped sealing members 23 and 24 are provided, while interposing the connecting section 25 therebetween, on the oil distributor 8. The sealing member 23 prevents the connection between the connecting section 25 and the space 14. The sealing member 24 prevents oil within the connecting section 25 from flowing to the outside via the gap between the outer periphery of the oil distributor 8 and the inner wall of the opening of the front cover 3.

The relationship between a length b of the sealing member 23 in the axial direction and a length c of the connecting section 25 in the axial direction is set such that b is greater than c (b>c). The oil distributor 8 attached with the sealing member 23 may be inserted to the front cover 3 smoothly without being caught by the connecting section 25 by setting the lengths as described above.

Thus, oil is supplied to the retarding hydraulic chambers 13*a*, 13*b* and 13*c* from the space 14 via the oil passages 21 and 22 radially provided through the inside of the supporting member 1*d* of the vane rotor 1. Further, oil is supplied to the advancing hydraulic chambers 12*a*, 12*b* and 12*c* from the oil distributor 8 via the oil passage 11 radially provided through the inside of the front cover 3.

The cylindrical bush 7 is press-fitted and fixed in the hollow portion 1*e* of the vane rotor 1, thereby forming a cylindrical protruding section. Therefore, it is possible to prevent the advancing hydraulic chambers 12*a*, 12*b* and 12*c* and the space 14 from communicating through the clearance 38 completely by the outer peripheral surface of the cylindrical bush 7 and the inner peripheral surface of the hollow portion 1*e*. Further, the sealing member 23 prevents the connecting section 25 and the space 14 from communicating each other. Accordingly, pressure oil within the space 14 will not be mixed with pressure oil within the advancing hydraulic chambers 12*a*, 12*b* and 12*c*, the oil passage 36, the oil passage 11 and the connecting section 25.

Further, a cylindrical sealing surface is formed between the outer peripheral surface of the cylindrical bush 7 and the inner peripheral surface of the opening of the front cover 3. Because this cylindrical sealing surface may be prolonged relatively in the axial direction, it can suppress pressure oil from leaking from the retarding hydraulic chambers 13*a*, 13*b* and 13*c* to the connecting section 25 via the clearance 38 and the gap between the cylindrical bush 7 and the inner peripheral surface of the opening.

Operations of the variable valve timing mechanism in the embodiment will now be described.

(1) When pressure oil is not introduced yet to any one of the advancing hydraulic chambers 12*a*, 12*b* and 12*c* and the retarding hydraulic chambers 13*a*, 13*b* and 13*c* from a pump 37 in starting the engine, the vane rotor 1 is positioned at the most retarded position with respect to the shoe housing 2 along the rotation of the crank shaft, the stopper piston 15 is engaged with the stopper hole 26 of the rear plate 4 by the bias force of the spring, and the vane rotor 1 is connected with the shoe housing 2 by the stopper piston 15 as shown in FIGS. 1 and 2. When pressure oil can be fully supplied from the pump 37 after starting the engine, oil is supplied to the hydraulic chamber 28 and the engagement of the stopper hole 26 with the stopper piston 15 is released (disengaged). Then, either one of the following operations (2) through (4) is selected.

(2) When a valve 31*a*of a change-over valve 31 is selected and pressure oil is press-fed from the pump 37, the pressure oil is supplied to the oil passages 33 and 34 and is distributed from the oil passage 34 to the retarding hydraulic chambers 13*a*, 13*b* and 13*c* via the space 14 and the oil passages 21 and 22 perforated through the supporting member 1*d*. Then, pressure oil in the advancing hydraulic chambers 12*a*, 12*b* and 12*c* is released to an oil tank 32. When pressure oil of the retarding hydraulic chambers 13*a*, 13*b* and 13*c* act on the side planes of the vanes 1*a*, 1*b* and 1*c* respectively, the vane rotor 1 rotates counterclockwise in FIG. 2, that is, in the retarding direction, with respect to the shoe housing 2, thereby retarding the valve timing of the camshaft 10.

(3) When a valve 31*c* of the change-over valve 31 is selected, pressure oil from the pump 37 is supplied to the oil passages 35 and 36 and is distributed from the oil passage 36 to the advancing hydraulic chambers 12*a*, 12*b* and 12*c* via the oil passage 11 perforated through the front cover 3. Pressure oil in the retarding hydraulic chambers 13*a*, 13*b* and 13*c* is released to the oil tank 32. When hydraulic pressures of the advancing hydraulic chambers 12*a*, 12*b* and 12*c* act on the side planes of the vanes 1*a*, 1*b* and 1*c* respectively, the vane rotor 1 rotates clockwise in FIG. 2, that is, in the advancing direction, with respect to the shoe housing 2, thereby advancing the valve timing of the camshaft 10.

(4) When a change-over valve 31*b* is selected during the rotation of the vane rotor 1 in the advancing direction or the retarding direction with respect to the shoe housing 2, oil in the retarding hydraulic chambers 13*a*, 13*b* and 13*c* and the advancing hydraulic chambers 12*a*, 12*b* and 12*c* is stopped from flowing in or out, and the vane rotor 1 is held at the intermediate position.

The position of the vane rotor 1 may be controlled, and the desirable valve timing may be obtained by adequately selecting the respective conditions (2) through (4) corresponding to the engine operating condition after starting the engine. Because the seal between the outer peripheral wall of the vane rotor 1 and the inner peripheral wall of the shoe housing 2 is always secured, it is possible to prevent pressure oil from leaking from respective hydraulic chambers via the inner wall surface of the shoe housing 2 in the respective conditions (2) through (4).

According to the embodiment of the present invention, pressure oil may be supplied to the hydraulic chambers even when it is difficult to provide oil passages within the camshaft 10 by the reason of conditions in designing the engine by supplying hydraulic pressure not by using the oil passage within the camshaft 10 but by using the oil distributor 8 inserted from the front side.

Further, hydraulic pressure is supplied to the both hydraulic chambers via the oil passage 11 provided within the front cover 3. Accordingly, the hydraulic pressure is supplied from the position apart from the small clearance provided between the vane rotor 1 and the front cover 3. It reduces the oil leakage to the oil passage via the small clearance 38.

The cylindrical bush 7 forming the cylindrical section is provided at the distal end of the oil distributor 8. The cylindrical bush 7 is loosely fitted in the large diameter portion of the opening at the center of the front cover 3, and the cylindrical sealing surface is formed by the outer peripheral surface of the cylindrical bush 7 and the inner peripheral surface of the opening. This cylindrical sealing surface allows the reduction of oil leakage from the retarding hydraulic chambers 13*a*, 13*b* and 13*c* to the connecting section 25. The cylindrical bush 7 is also press-fitted and fixed in the hollow portion 1*e* of the vane rotor 1, thereby forming the cylindrical protruding section. Accordingly,the advancing hydraulic chambers 12*a*, 12*b* and 12*c* are prevented from communicating with the space 14 via the clearance 38.

Further, the sealing member 23 prevents the oil passage 11, provided in the front cover 3 for supplying oil to the advancing hydraulic chambers, from communicating with the space 14. The sealing member 24 prevents oil from flowing to the outside from the connecting section 25 via the gap between the outer peripheral surface of the oil distributor 8 and the inner wall of the insertion hole of the front cover 3.

As described above, the cylindrical bush 7 and the sealing member 23 prevent the advancing side and the retarding side from communicating each other. Further, because the sealing member 23 prevents pressure oil from leaking to the outside, the phase difference of the vane rotor 1 with respect to the housing main body 9 may be controlled with high degree of accuracy.

Although pressure oil is supplied to the advancing hydraulic chambers 12*a*, 12*b* and 12*c* by using the oil passage 11 provided within the front cover 3, and is supplied to the retarding hydraulic chambers 13*a*, 13*b* and 13*c* by using the oil passages 21 and 22 provided within the vane rotor 1 according to the embodiment described above, it is possible to construct in the opposite way. It is also possible to provide oil passages for supplying oil to the both advancing and retarding hydraulic chambers in the front cover 3 to supply oil therethrough.

Although the cylindrical bush 7 has been press-fitted and fixed in the hollow portion 1*e* of the vane rotor 1 in the embodiment described above, the cylindrical bush 7 may be press-fitted and fixed in the large diameter section of the opening of the front cover 3. In this case, the communication between the advancing hydraulic chambers 12*a*, 12*b* and 12*c* and the space 14 via the clearance 38 is suppressed by the cylindrical sealing surface between the outer peripheral surface of the cylindrical bush 7 and the hollow portion 1*e* at the center part of the vane rotor 1. The oil leakage from the retarding hydraulic chambers 13*a*, 13*b* and 13*c* to the connecting section 25 may be reduced by the cylindrical sealing surface formed between the outer peripheral surface of the cylindrical bush 7 and the center opening of the front cover 3.

Further, the cylindrical bush 7 may loosely be fitted in both of the hollow portion 1*e* of the vane rotor 1 and the large diameter section of the opening of the front cover 3, instead of press-fitting and fixing to either of them. In this case, the oil leakage via the outer peripheral surface of the cylindrical bush 7 cannot be prevented completely either at the hollow portion 1*e* side or the connecting section 25 side. However, the oil leakage may be reduced by the outer peripheral surface of the cylindrical bush 7 and the cylindrical sealing surface formed between the hollow portion 1*e* and the center opening of the front cover 3.

(Second Embodiment)

Figure 3:
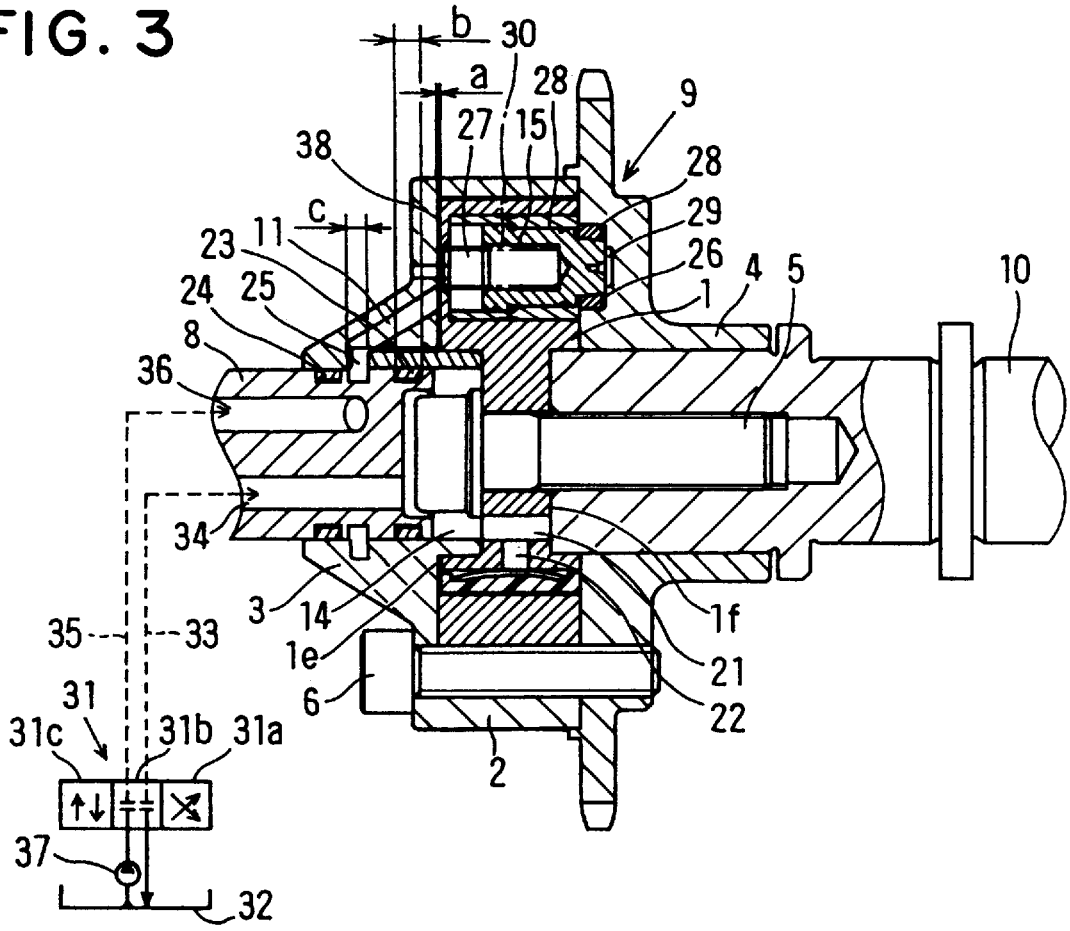
FIG. 3 is a longitudinal cross section of a variable valve timing mechanism according to a second embodiment of the present invention.

Furthermore, the cylindrical bush 7 may be integrally molded with either one of the vane rotor 1 or the large diameter section of the opening of the front cover 3 as a cylindrical protrusion, instead of using it as the separate part. A second embodiment of the present invention is shown in FIG. 3. In the second embodiment, the cylindrical bush 7 is integrally molded with the front cover 3, and that is the only difference between the first and the second embodiments. According to the second embodiment of the present invention, the same sealing effect as the case when the cylindrical bush 7 is press-fitted and fixed in either one of the vane rotor 1 or the opening large diameter section can be obtained because the condition in which the cylindrical bush 7 is press-fitted and fixed may be obtained from the beginning.

(Third Embodiment)

Figure 4:
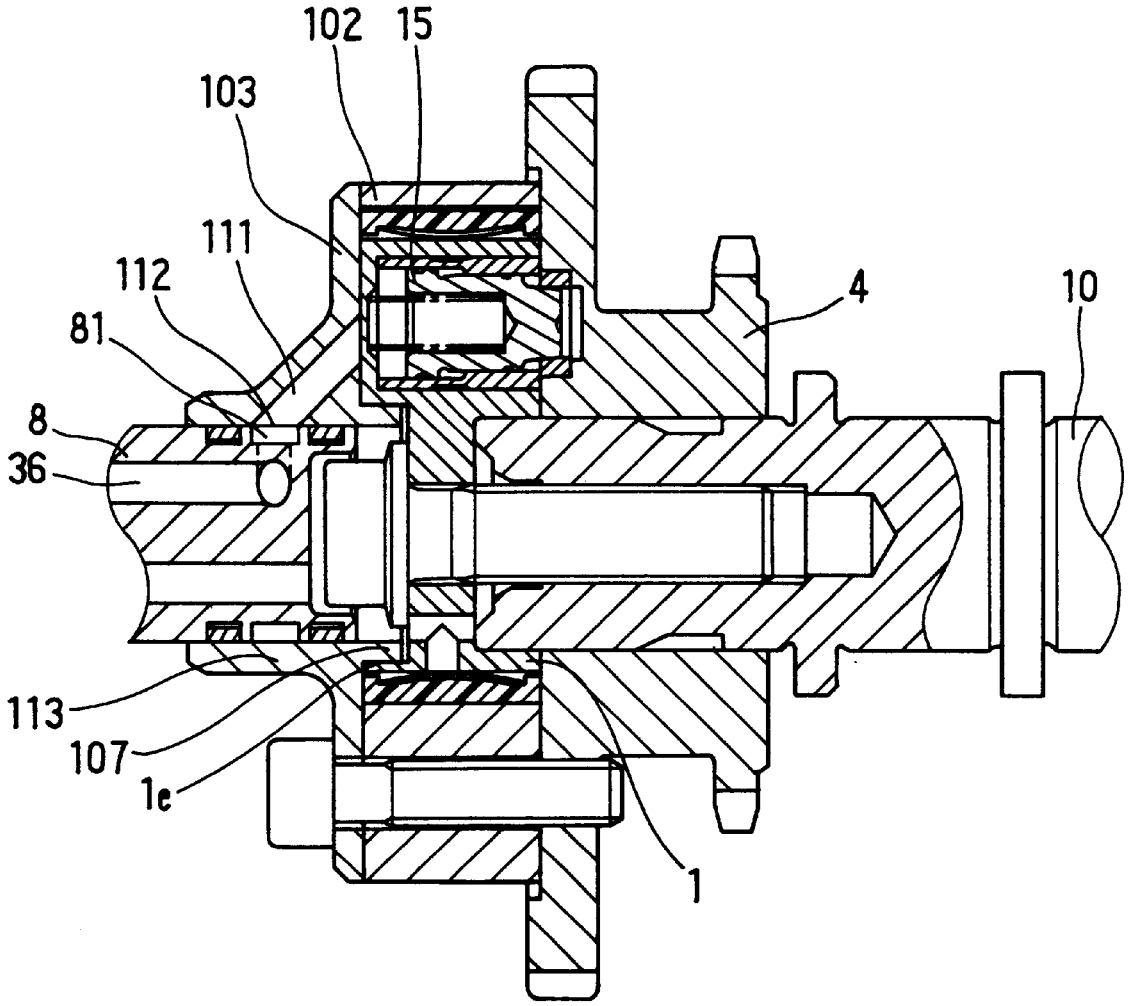
FIG. 4 is a longitudinal cross section of a variable valve timing mechanism according to a third embodiment of the present invention.

In FIG. 4, the same parts as in FIG. 3 are indicated by the same reference of FIG. 3. In the third embodiment, a cylindrical shoe housing 102 and a disk-shaped front cover 103 are formed as separated parts. The shoe housing 102 is made of aluminum, and is similar to a cylindrical portion of the shoe housing 2 described in the first and second embodiments. The front cover 103 is made of a harder material, such as iron. The front cover 103 has a cylindrical portion 113 to provide a straight receiving bore for the oil distributor 8 and an oil passage 111 similar to the oil passage 11 of the second embodiment. The oil passage 111 is communicated to the bore of the cylindrical portion 113 via a circular opening 112. The oil passage 36 communicates to the oil passage through an annular groove 81 on the oil distributor 8 and the opening 112. The front cover 103 also has a cylindrical bush 107 protruding from an inner surface of the front cover 103. The bush 107 is inserted into the hollow portion 1*e* of the vane rotor 1 with a small gap. A cylindrical clearance extending in an axial direction is formed between an outer surface of the bush 107 and an inner surface of the hollow portion 1*e*. In this embodiment, it is possible to use a preferable material for the shoe housing 102 and the front cover 103 respectively. It is possible to prevent a wearing of the front cover 103, because the front cover 103 is made of iron. Further, the oil distributor 8 can be smoothly inserted into the bore.

(Fourth Embodiment)

Figure 5:
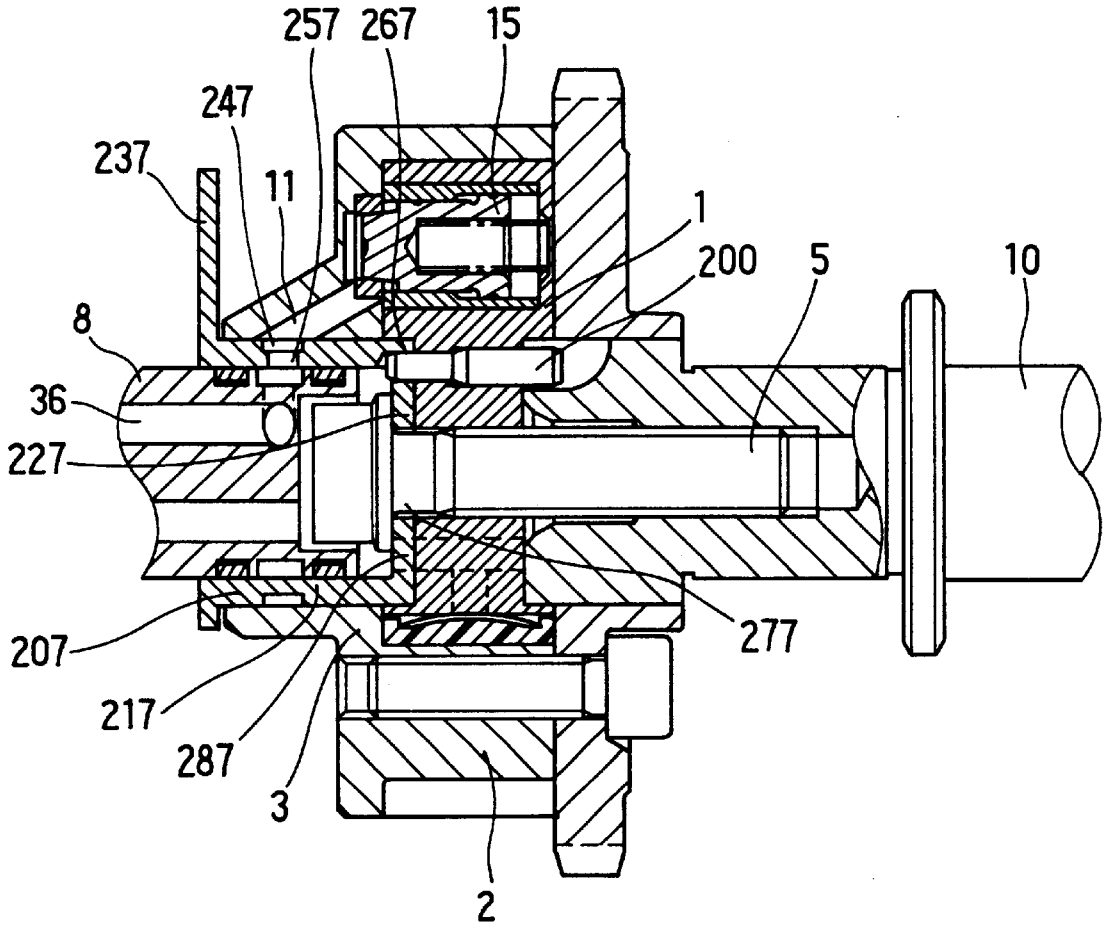
FIG. 5 is a longitudinal cross section of a variable valve timing mechanism according to a fourth embodiment of the present invention.

In FIG. 5, the same parts as in FIG. 1 are indicated by the same reference of FIG. 1. In the fourth embodiment, the bush 207 is made of iron and formed as a cup-shape. The shoe housing 2 and the front cover 3 are integrally formed and made of aluminum. The bush 207 has a cylindrical wall 217, a bottom wall 227 and a flange 237. An annular groove 247 is formed on an outside of the cylindrical wall 217. A through hole 257 is formed to connect the oil passage 36 of the oil distributor 8 and the oil passage 11 through the annular groove 247. The cylindrical wall 217 has a straight inner bore to receive the oil distributor 8. The bottom wall 227 has three holes such as a positioning hole 267 to be coupled with a pin 200, a center hole 277 for receiving the center bolt 5 and a oil passage hole 287 to provide a oil passage. The bush 207 is fixed on the vane rotor 1 by the pin 200 and the center bolt 5. The flange 237 is formed as a signal rotor of a magnetic pulse generator to provide a signal indicating a rotational angle of the camshaft 10. The bush 207 is inserted into the hollow portion of the shoe housing 2 with a small gap. A cylindrical clearance extending in an axial direction is formed between an outer surface of the bush 207 and an inner surface of the hollow portion of the shoe housing 2. As shown in FIG. 5, an arrangement of the stopper piston 15 is reversed relative to the embodiment of FIG. 1, FIG. 3 and FIG. 4.

Although the present invention has been described in connection with the preferred embodiment thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A variable valve timing mechanism for an internal combustion engine having an intake valve, an exhaust valve and a drive shaft, comprising:

a housing having a first end and a second end;

a driven shaft for opening and closing at least one of the intake valve and the exhaust valve by receiving driving force from the drive shaft, said driven shaft being extended from said first end of said housing;

a vane rotor being rotatable relative to said housing within a predetermined rotational phase difference, said vane rotor being accommodated in said housing to define a plurality of oil pressure chambers between said vane rotor and said housing in a circumferential direction of said vane rotor, said driving force being transmitted via said housing, said oil pressure chambers and said vane rotor; and an oil distributor for distributing an oil to said oil pressure chambers from said second end of said housing, said oil distributor being supported by said second end of said housing and being opposed to said driven shaft.

2. A variable valve timing mechanism as in claim 1, wherein:

said oil distributor is disposed opposite to said housing and said vane rotor; and said oil distributor includes a first oil passage for distributing said oil to said oil pressure chambers.

3. A variable valve timing mechanism as in claim 2, wherein said housing includes a second oil passage for communicating said first oil passage and said oil pressure chambers.

4. A variable valve timing mechanism for an internal combustion engine having an intake valve, an exhaust valve and a drive shaft, comprising:

a housing having a first end and a second end;

a driven shaft for opening and closing at least one of the intake valve and the exhaust valve by receiving driving force from the drive shaft, said driven shaft being extended from said first end of said housing;

a vane rotor being rotatable relative to said housing within a predetermined rotational phase difference, said vane rotor being accommodated in said housing to define a plurality of oil pressure chambers between said vane rotor and said housing in a circumferential direction of said vane rotor, said driving force being transmitted via said housing, said oil pressure chambers and said vane rotor;

an oil distributor for distributing an oil to said oil pressure chambers from said second end of said housing, said oil distributor being supported by said second end of said housing and being opposed to said driven shaft; and a cylindrical member disposed between said oil distributor and at least one of said housing and said vane rotor for preventing said oil from leaking from said oil pressure chambers via a clearance between said housing and said vane rotor.

5. A variable valve timing mechanism as in claim 4, wherein said cylindrical member includes a pipe-shaped protrusion hermetically formed on one of said housing and said vane rotor.

6. A variable valve timing mechanism as in claim 5, wherein said pipe-shaped protrusion includes a cylindrical bush press-fitted and fixed in said one of said housing and said vane rotor.

7. A variable valve timing mechanism as in claim 5, wherein said pipe-shaped protrusion is integrally formed with said one of said housing and said vane rotor.

8. A variable valve timing mechanism as in claim 3, wherein said mechanism further includes a first seal member and a second seal member installed in said oil distributor, and wherein;

a connection between said first oil passage and said second oil passage is axially interposed between said first seal member and said second seal member.

9. A variable valve timing mechanism as in claim 4, wherein said mechanism further includes a first seal member and a second seal member installed in said oil distributor, and wherein;

said oil distributor is disposed opposite to said housing and said vane rotor;

said oil distributor includes a first oil passage for distributing said oil to said oil pressure chambers;

said housing includes a second oil passage for communicating said first oil passage and said oil pressure chambers; and a connection between said first oil passage and said second oil passage is axially interposed between said first seal member and said second seal member.

10. A variable valve timing mechanism as in claim 9, wherein said first seal member seals between said oil distributor and said cylindrical member, and said second seal member seals between said oil distributor and said housing.

11. A variable valve timing mechanism as in claim 4, further comprising a sealing member installed on an outer surface of said oil distributor, wherein said vane rotor has a hollow portion opposing to said oil distributor, said cylindrical member is inserted into said hollow portion in a sealing manner and provides a sealing surface to be made contact with said sealing member, and said oil distributor provides two oil passages separated by said sealing member.

12. A variable valve timing mechanism as in claim 4, wherein said cylindrical member has a through hole providing an oil passage between said oil distributor and said oil pressure chambers.

13. A variable valve timing mechanism as in claim 4, wherein said cylindrical member is fixed on said vane rotor and has a signal rotor.

14. A variable valve timing mechanism as in claim 13, wherein said cylindrical member is formed into a cup-shape having a bottom wall fixed to said vane rotor.

15. A variable valve timing mechanism for an internal combustion engine having an intake valve, an exhaust valve and a drive shaft, comprising:

a housing having a first end and a second end;

a shaft extended from said first end of said housing to operate at least one of the intake valve and the exhaust valve; and a vane rotor being rotatable relative to said housing within a predetermined rotational phase difference, said vane rotor being accommodated in said housing to define a plurality of oil pressure chambers between said vane rotor and said housing in a circumferential direction of said vane rotor, wherein a cylindrical portion is located in one of said housing and said vane rotor to provide an inner surface defining a cavity opened in said second end of said housing and being made contact with an oil sealing member, and to provide a sealing surface opposing to another one of said housing and said vane rotor to define a cylindrical clearance extending in an axial direction.

16. A variable valve timing mechanism as in claim 15, further comprising an oil distributor having said oil sealing member thereon and two oil passages to be separated by said oil sealing member, and being inserted into said cavity of said cylindrical portion.

17. A variable valve timing mechanism as in claim 15, wherein said housing comprises a shoe housing made of aluminum and a cover made of iron, and said cylindrical portion is integrally formed in said cover.

18. A variable valve timing mechanism as in claim 15, wherein said housing is made of aluminum includes a shoe housing portion and a cover portion integrally formed, and said cylindrical portion is made of iron.

19. A variable valve timing mechanism as in claim 18, wherein said cylindrical portion is formed as a cup having a cylindrical wall and a bottom wall fixed to said vane rotor by a bolt for fixing said vane rotor to said driven shaft.

20. A variable valve timing mechanism as in claim 18, wherein said cylindrical portion further comprises a signal rotor integrally formed thereon.

* * * * *